US006685439B1

(12) United States Patent
Harrell et al.

(10) Patent No.: US 6,685,439 B1
(45) Date of Patent: Feb. 3, 2004

(54) HYDRAULIC JET PUMP

(76) Inventors: Gary Harrell, HC1 Box 224, Plainview, TX (US) 79072; Jerry Andrews, Rte. 4, Box 277, Seminole, OK (US) 74868; Jimmy Jones, 2501 Goforth, Kilgore, TX (US) 75662

( * ) Notice: Subject to any disclaimer, the term of this patent is extended or adjusted under 35 U.S.C. 154(b) by 0 days.

(21) Appl. No.: 10/147,363

(22) Filed: May 15, 2002

(Under 37 CFR 1.47)

(51) Int. Cl.[7] ..... F04F 5/00
(52) U.S. Cl. ..... 417/151; 417/170; 417/174; 166/68; 166/372
(58) Field of Search ..... 417/151, 170, 417/172, 174, 185, 76, 79; 166/105, 105.1, 68, 372

(56) References Cited

U.S. PATENT DOCUMENTS

| | | | | | |
|---|---|---|---|---|---|
| 4,183,722 | A | | 1/1980 | Roeder | 417/172 |
| 4,293,283 | A | * | 10/1981 | Roeder | 417/172 |
| 4,658,893 | A | * | 4/1987 | Black | 166/68 |
| 4,790,376 | A | * | 12/1988 | Weeks | 166/68 |
| 5,083,609 | A | * | 1/1992 | Coleman | 166/68 |
| 5,667,364 | A | * | 9/1997 | O Mara et al. | 417/151 |
| 6,354,371 | B1 | * | 3/2002 | O'Blanc | 166/69 |

OTHER PUBLICATIONS

1998–1999 Catalog of Oilfield Products Trico Industries, Inc., pp. 1702–1703, 1714–1721, copyright 1997 (no month).

* cited by examiner

*Primary Examiner*—Justine R. Yu
*Assistant Examiner*—Han Lieh Liu
(74) *Attorney, Agent, or Firm*—Sierra Patent Group, Ltd.

(57) ABSTRACT

A hydraulic jet pump comprising: a nozzle housing; a nozzle member disposed within said nozzle housing and including an inlet aperture communicating through a jet nozzle with a mixing chamber along a power fluid inlet flow path; a deflector member including an axial bore formed partially therethrough from an input aperture at a first end thereof towards a second end thereof, said input aperture communicating with said mixing chamber, said deflector member further including a plurality of radially-disposed deflector outlet ports communicating with said axial bore and disposed at an acute angle with respect to said input aperture to form a flow path having an output flow direction disposed at an acute angle with respect to an input flow direction from said input aperture, said deflector member further including a plurality of axially-aligned vacuum inlet ports formed therethrough from said first end to said second end and in communication with said mixing chamber but not with said deflector outlet ports.

14 Claims, 5 Drawing Sheets

HYDRAULIC JET PUMP

BACKGROUND OF DISCLOSED APPARATUS

1. Field of Disclosed Apparatus

The present disclosed apparatus relates downhole hydraulic jet pump assemblies.

2. Description of the Related Art

The in creased world-wise use and demand for oil and gas has generated a need for the retrieval of oil and gas from underground locations. Therefore many advances have been made in increasing the efficiencies and lowering the costs in removing oil and gas from subterranean formations.

In a typical oil and gas recovery process a steel tubular casing, extending the length of the well, is inserted into a drilled well and uncured concrete is pumped down the casing. Upon forcing of the concrete out of the bottom of the casing, it fills an annular space between an outer surface of the casing and the walls of the well, where the concrete cures to firmly anchor the casing to the well walls and seals off the well. To access the oil or gas through the now sealed well casing, the casing and the concrete are perforated at a downhole depth adjacent to the oil or gas subsurface formation. These perforations allow the oil and/or gas fluid to enter the well casing from the formation for retrieval. Due to the difference in pressure between the formation and the well casing interior, the inrush of the fluid into the well is substantial enough to clean the perforation passages of any debris for unobstructed passage of fluid into the casing.

In some regions, such as in the Middle East, sufficient bottom hole pressure, via natural gas, often is available in the formation to force the production fluid to the surface, where it can be collected and utilized for commercial purposes. As the localized natural gas in these drilled formations begin to deplete, various techniques are utilized to continue oil and gas production from the wellbore, these techniques are known in the industry as artificial lift. The artificial lift methods will require the insertion of a smaller jointed steel pipe into the original casing typically referred to as tubing. One such artificial lift technique employs the use of produced natural gas, this production method is referred to as gas lift. The produced natural gas and associated apparatus are employed to inject gas into the production fluids to assist lifting of them to the surface. This gas injection typically involves inserting a smaller diameter jointed gas lift tube into the well casing. The gas lift tube includes a plurality of perforated gas lift mandrels formed for discharging gas. As the gas passes through the mandrels and into the production fluid in the annulus formed between the casing and the jointed tube, the gas mixes with, and is entrained in the production fluid, causing the density, and hence the column fluid weight or gradient, to decrease. This lower weight enables the current, lower, down-hole pressure to lift the production fluids to the surface for collection.

In time, however, water seeps into or permeates the well column, which eventually impedes or prevents removal of the production fluids through gas lifting techniques. Traditionally, water is removed by purging the well with nitrogen. Purging is typically performed by inserting coil tubing into the jointed gas lift tube which coil tubing includes a one-way valve situated at the lower or distal end thereof. Nitrogen gas is discharged through the valve which exits the coil tubing at a sufficient pressure and rate to purge the undesirable water from the annulus. This purge permits the formation or production fluids to enter the annulus through the casing perforations for lifting to the surface.

While this technique has proven sufficient to remove water from the well column, the costs associated with operation can escalate. This is primarily due to the amount of nitrogen gas which must be discharged from the coil tubing, which is substantial. Other gases may be employed for purging but nitrogen is inert and available.

In some instances, a more cost-effective approach than the use of nitrogen purging may be used. A hydraulic or down-hole jet pump can be attached to the end of the tubing and lowered into the well casing to pump water and/or production fluid from the column. Hydraulic or down-hole jet pumps are often favored over mechanical-type pumps in situations such as de-watering of wells or production fluid pumping. Briefly, jet pumps generally include a power fluid line operably coupled to the entrance of the jet pump, and a return line coupled to receive fluids from a discharge end of the pump. As the pressurized power fluid is forced, by a pump at the surface, down through the down-hole jet pump, the power fluid draws in and intermixes with the production fluid. The power fluid and production fluid (oil and/or gas) then are pumped to the surface through the return line, and the production fluid may then be recovered, together with the power fluid. Jet pumps are often advantageous since they generally involve substantially fewer moving parts than mechanical pumps, thereby increasing the reliability of the jet pump.

SUMMARY OF THE DISCLOSED APPARATUS

The presently disclosed apparatus relates to a hydraulic jet pump comprising: a nozzle housing; a nozzle member disposed within said nozzle housing and including an inlet aperture communicating through a jet nozzle with a mixing chamber along a power fluid inlet flow path; a deflector member including an axial bore formed partially therethrough from an input aperture at a first end thereof towards a second end thereof, said input aperture communicating with said mixing chamber, said deflector member further including a plurality of radially-disposed deflector outlet ports communicating with said axial bore and disposed at an acute angle with respect to said input aperture to form a flow path having an output flow direction disposed at an acute angle with respect to an input flow direction from said input aperture, said deflector member further including a plurality of axially-aligned vacuum inlet ports formed therethrough from said first end to said second end and in communication with said mixing chamber but not with said deflector outlet ports.

BRIEF DESCRIPTION OF THE DRAWINGS

The present disclosed apparatus is described in greater detail by referencing the accompanying drawings.

DETAILED DESCRIPTION

Those of ordinary skill in the art will realize that the following description of the present disclosed apparatus is illustrative only and not in any way limiting. Other embodiments of the disclosed apparatus will readily suggest themselves to such skilled persons.

Figure 1:
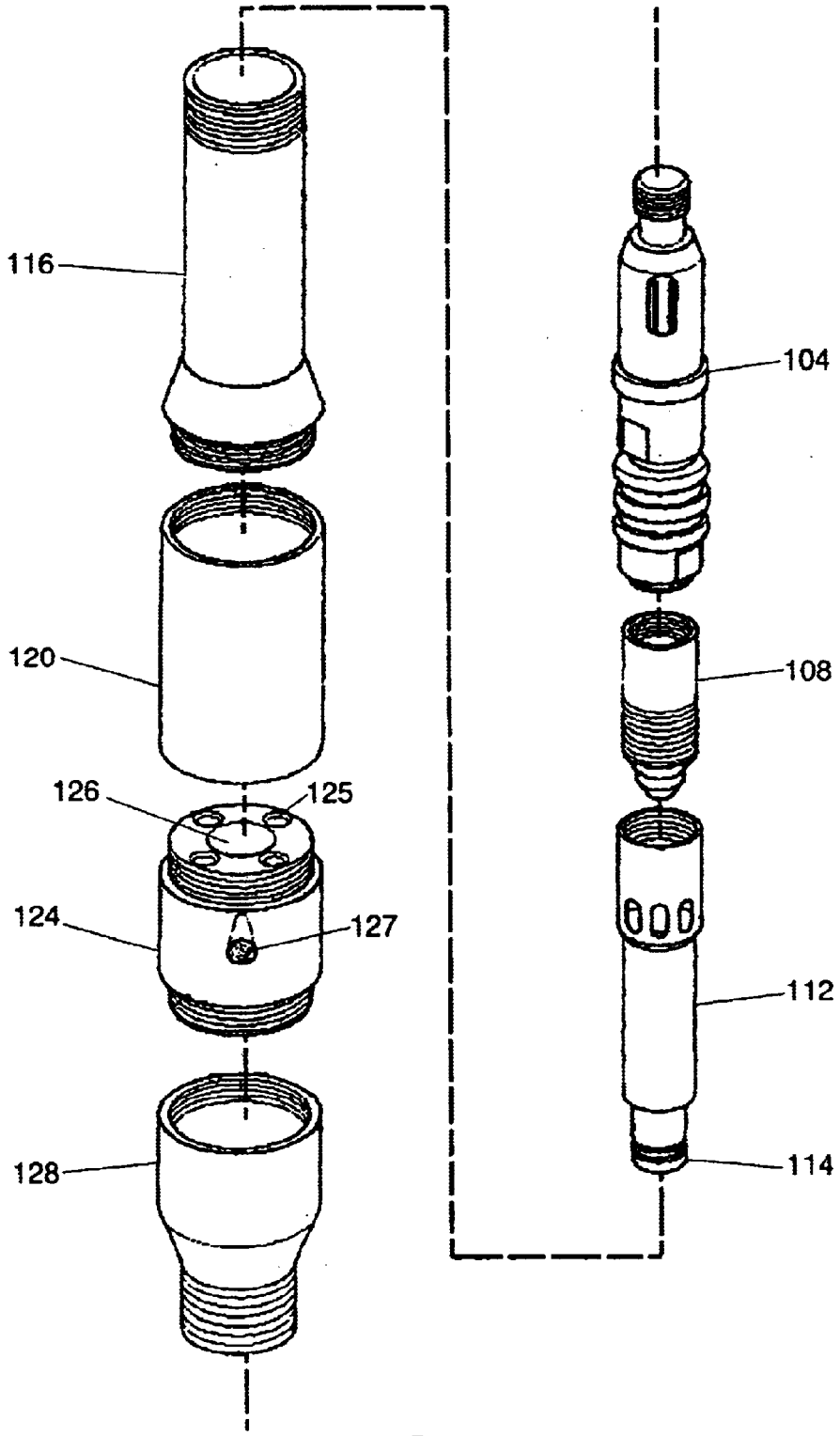
FIG. 1 is a drawing illustrating one embodiment of the disclosed apparatus.

Referring to FIG. 1, one embodiment of the disclosed jet pump is shown. The nozzle assembly 104, 108 and 112 is shown apart from the housing assembly 116, 120, 124, and 128.

The power fluid inlet 104 is coupled to the nozzle 108. The nozzle 108 is coupled to the mixing tube 112.

The tubing adapter 116 is coupled to the production jet housing 120. The production jet housing 120 is coupled to the deflector body 124. The deflector body is coupled to the production inlet adapter 128. A check valve and formation packer, which creates a seal between the tubing and the production casing, are installed below the disclosed jet pump.

The nozzle assembly 104, 108 and 112 sits in the housing assembly, specifically the end 114 of the mixing tube 112 sits in the cavity 126 of the deflector body 124. The production ports 125 of the deflector body as are the production/power fluid outlets 127 are disclosed more fully with respect to FIGS. 3*a* and 3*b*.

In one embodiment of the jet pump, the nozzle assembly can be propelled to the surface by reversing the flow of the power fluid.

Figure 2:
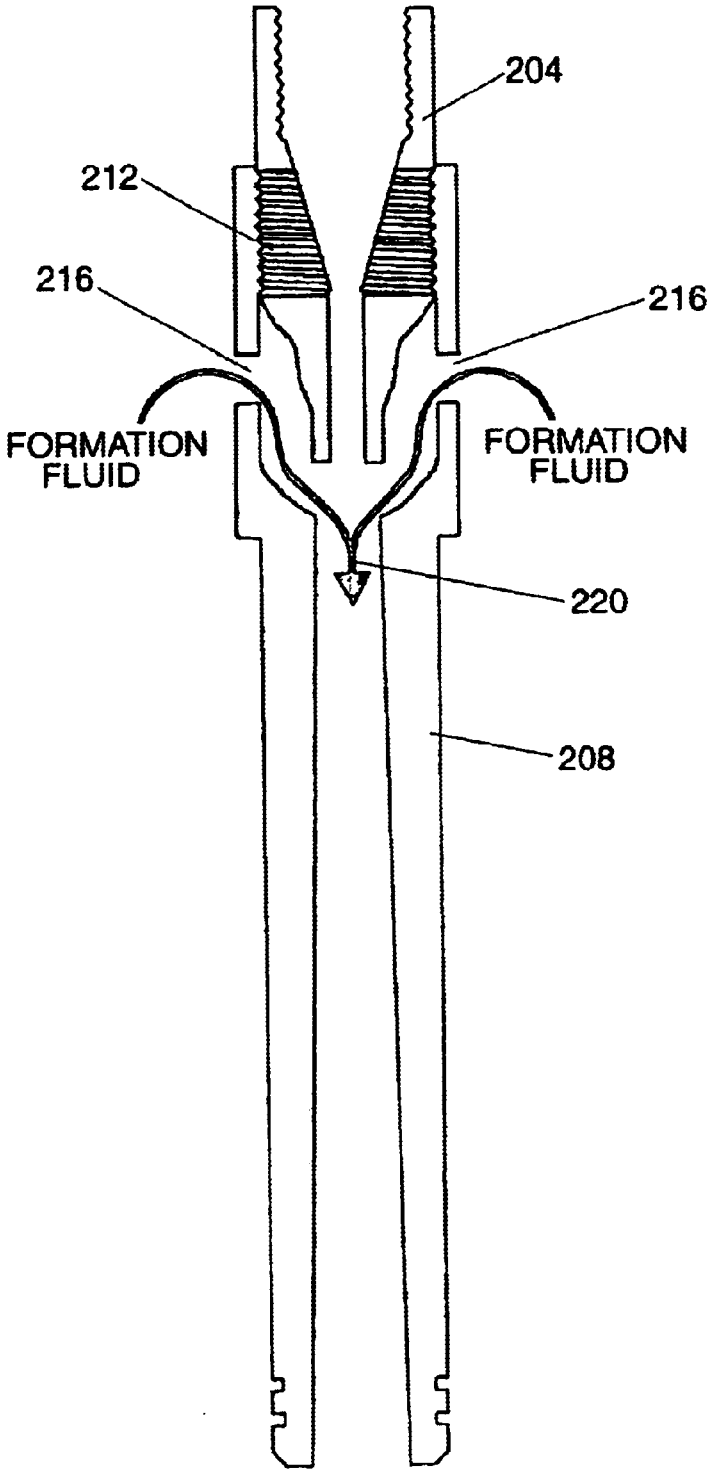
FIG. 2, is a cross-sectional drawing illustrating the nozzle and mixing tube.

Referring now to FIG. 2, a more detailed view of the nozzle 204 and mixing tube 208 is shown (108 and 112 from FIG. 1). Adjustment threads 212 are shown which allow for adjustable coupling of the nozzle 204 to the mixing tube 208. By adjusting the amount of thread engaged at 212, a user may vary the amount of vacuum created by the venturi effect of the nozzle. The vacuum effect pulls the formation fluid through the production inlet 216 of the mixing tube and the formation fluid and power fluid mix in what may also be called a mixing chamber 220.

Figure 3A:
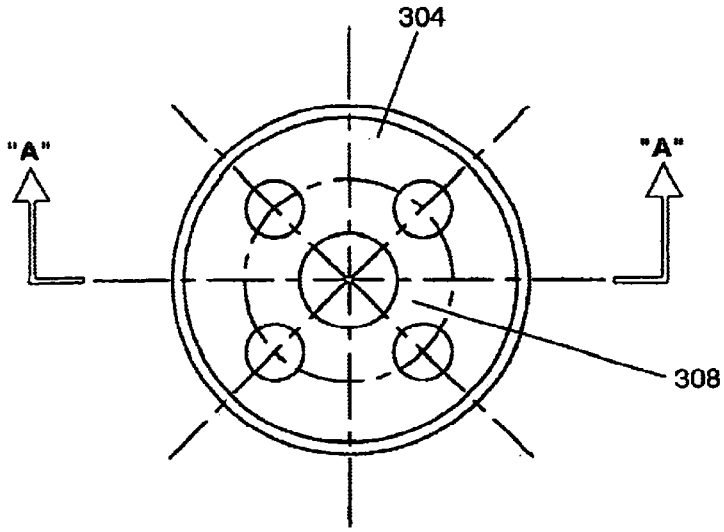
FIGS. 3*a* and 3*b* are drawings illustrating the deflector body.
Figure 3B:
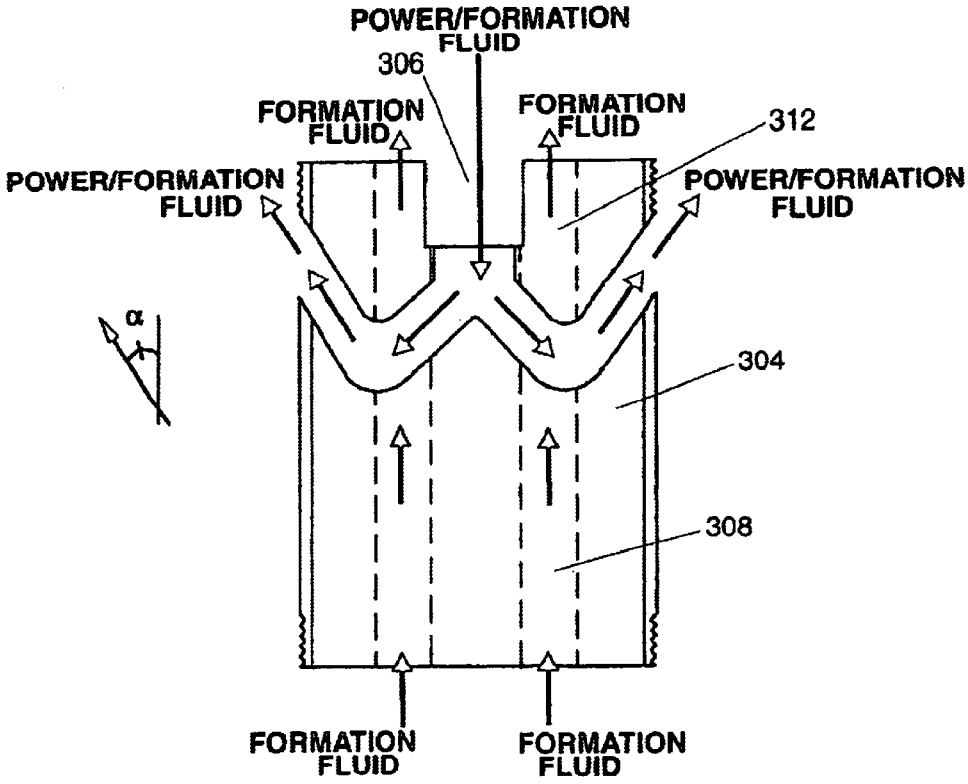

Referring now to FIGS. 3*a* and 3*b*, a more detailed view of the deflector body is shown. FIG. 3*a* shows a top view of the deflector body 304. Four production ports 308 are shown (125 in FIG. 1). FIG. 3*b* shows a cross-sectional view of the deflector body 304. The production ports 308 are indicated by the dashed lines. The end of the mixing tube 114 from FIG. 1 seats in the cavity 306. The path of the power/formation fluid from the end of the mixing tube through the deflector body has been described as a "U-turn" in that the fluid is angled such that when it exits the production/power fluid outlets 312 it is traveling in a somewhat uphole direction. Note that the production/power fluid outlets are not shown in FIG. 3*a*. The angle $\alpha$ of this uphole direction may be from 45° to 60°. This angle $\alpha$ may provide for greater extraction of formation fluid from the well.

Figure 4A:
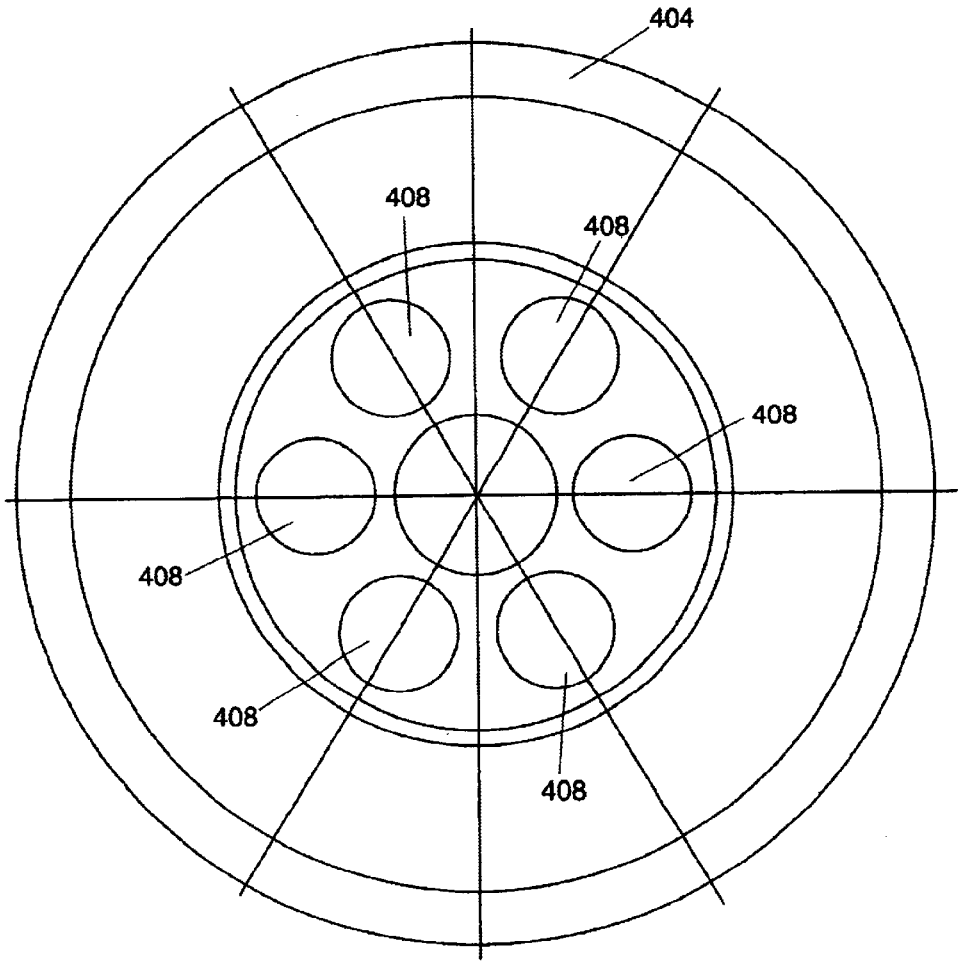
FIGS. 4*a* and 4*b* are drawings illustrating another embodiment of the deflector body.
Figure 4B:
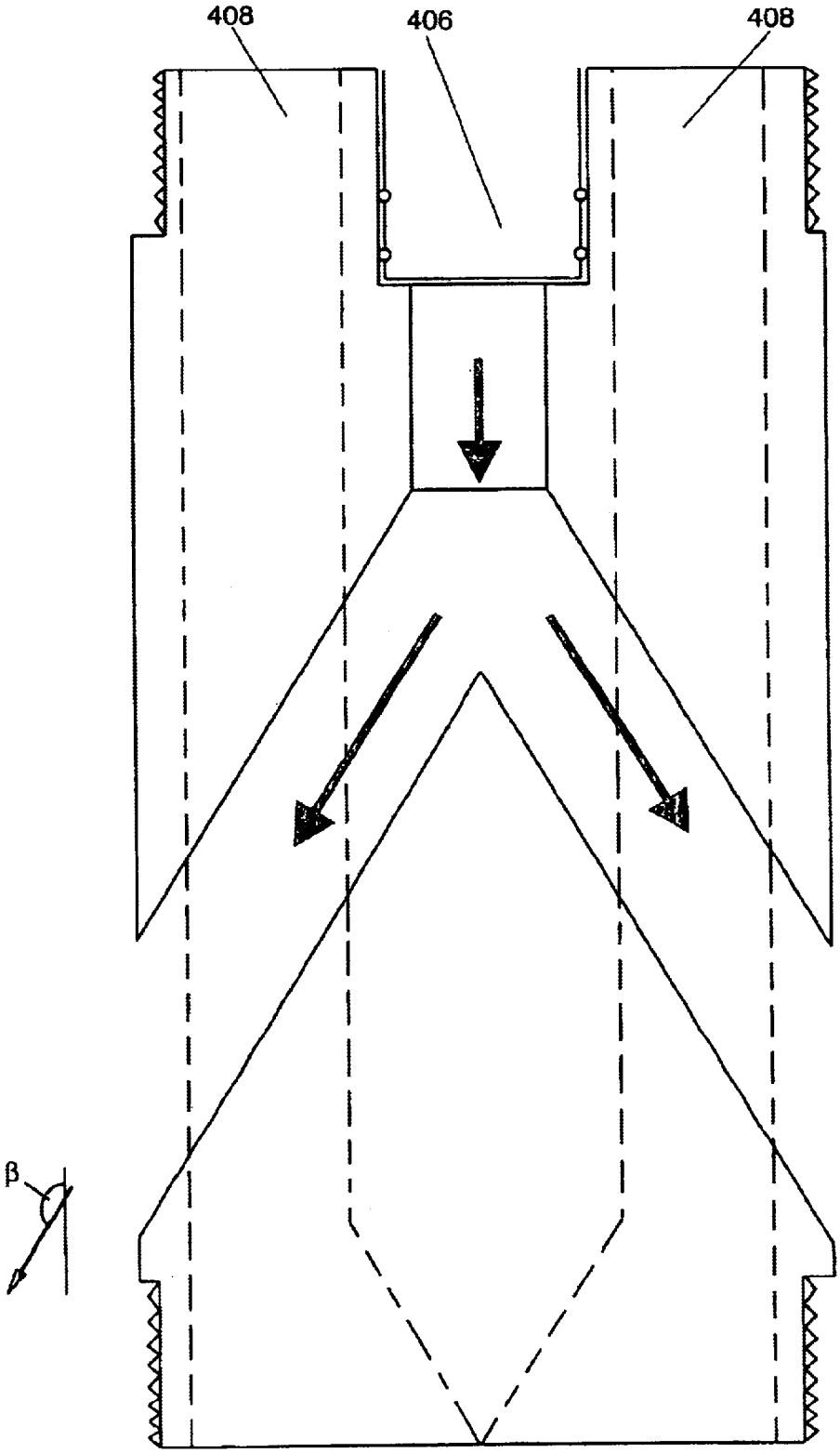

Another embodiment of the deflector body is shown in FIGS. 4*a* and 4*b*. FIG. 4*a* shows a top view of the deflector body 404. Six production ports 408 are shown. FIG. 4*b* shows a cross-sectional view of the deflector body 404. Two of the six production ports 408 are indicated by the dashed lines. The end of the mixing tube 114 from FIG. 1 seats in the cavity 406. The path of the power/formation fluid from the end of the mixing tube through the deflector body is not a U-turn as shown in FIG. 3, but rather is directed at an angle $\beta$ from the inlet in a down hole direction. Note that the production/power fluid outlets are not shown in FIG. 4*a*. The angle $\beta$ may be from 150° to 120°. This angle a may provide for greater extraction of formation fluid from the well. This embodiment may be used for casings of relatively larger inner diameter, such as seven inch casings.

While embodiments and applications of this disclosed apparatus have been shown and described, it would be apparent to those skilled in the art that many more modifications than mentioned above are possible without departing from the inventive concepts herein. The disclosed apparatus, therefore, is not to be restricted except in the spirit of the appended claims.

What is claimed is:

1. A hydraulic jet pump comprising:

a nozzle housing;

a nozzle member disposed within said nozzle housing and including an inlet aperture communicating through a jet nozzle with a mixing chamber along a power fluid inlet flow path;

a deflector member including an axial bore formed partially therethrough from an input aperture at a first end thereof towards a second end thereof, said input aperture communicating with said mixing chamber, said deflector member further including a plurality of radially-disposed deflector outlet ports communicating with said axial bore and disposed at an acute angle with respect to said input aperture to form a flow path having an output flow direction disposed at an acute angle with respect to an input flow direction from said input aperture, said deflector member further including a plurality of axially-aligned vacuum inlet ports formed therethrough from said first end to said second end and in communication with said mixing chamber but not with said deflector outlet ports.

2. The hydraulic jet pump of claim 1, wherein said nozzle housing and deflector member are cylindrical.

3. The hydraulic jet pump of claim 1, wherein said nozzle member is axially adjustable with respect to said mixing chamber.

4. The hydraulic jet pump of claim 3, wherein an outer surface of said nozzle member is threaded and adjustably coupled to a threaded inner surface of said mixing chamber.

5. The hydraulic jet pump of claim 1, wherein said nozzle member and said mixing chamber are removable from a down hole position.

6. The hydraulic jet pump of claim 5, wherein said nozzle member and said mixing chamber may be ejected from a down hole position by reversing the flow of a power fluid.

7. The hydraulic jet pump of claim 1, wherein said acute angle is approximately in the range of about 45° to 60°.

8. A hydraulic jet pump comprising:

a nozzle housing;

a nozzle member disposed within said nozzle housing and including an inlet aperture communicating through a jet nozzle with a mixing chamber along a power fluid inlet flow path;

a deflector member including an axial bore formed partially therethrough from an input aperture at a first end thereof towards a second end thereof, said input aperture communicating with said mixing chamber, said deflector member further including a plurality of radially-disposed deflector outlet ports communicating with said axial bore and disposed at an obtuse angle with respect to said input aperture to form a flow path having an output flow direction disposed at an obtuse angle with respect to an input flow direction from said input aperture, said deflector member further including a plurality of axially-aligned vacuum inlet ports formed therethrough from said first end to said second end and in communication with said mixing chamber but not with said deflector outlet ports.

9. The hydraulic jet pump of claim 8, wherein said nozzle housing and deflector member are cylindrical.

10. The hydraulic jet pump of claim 8, wherein said nozzle member is axially adjustable with respect to said mixing chamber.

11. The hydraulic jet pump of claim 10, wherein an outer surface of said nozzle member is threaded and adjustably coupled to a threaded inner surface of said mixing chamber.

12. The hydraulic jet pump of claim 8, wherein said nozzle member and said mixing chamber are removable from a down hole position.

13. The hydraulic jet pump of claim 12, wherein said nozzle member and said mixing chamber may be ejected from a down hole position by reversing the flow of a power fluid.

14. The hydraulic jet pump of claim 8, wherein said obtuse angle is approximately in the range of about 150° to 120°.

* * * * *